US011672272B2

(12) United States Patent
Rojo-Calderon et al.

(10) Patent No.: US 11,672,272 B2
(45) Date of Patent: Jun. 13, 2023

(54) AEROSOL-GENERATING COMPONENT FOR USE IN AN AEROSOL-GENERATING ARTICLE

(71) Applicant: Philip Morris Products S.A., Neuchatel (CH)

(72) Inventors: Noelia Rojo-Calderon, Neuchatel (CH); Rui Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 823 days.

(21) Appl. No.: 16/061,412

(22) PCT Filed: Dec. 21, 2016

(86) PCT No.: PCT/EP2016/082118
§ 371 (c)(1),
(2) Date: Jun. 12, 2018

(87) PCT Pub. No.: WO2017/108912
PCT Pub. Date: Jun. 29, 2017

(65) Prior Publication Data

US 2020/0260777 A1 Aug. 20, 2020

(30) Foreign Application Priority Data

Dec. 23, 2015 (EP) ..... 15202621

(51) Int. Cl.
*A24F 42/10* (2020.01)
*A24F 42/60* (2020.01)
(Continued)

(52) U.S. Cl.
CPC ..... *A24C 5/00* (2013.01); *A24C 5/01* (2020.01); *A24D 1/22* (2020.01); *A24F 42/10* (2020.01);
(Continued)

(58) Field of Classification Search
CPC ..... A24F 42/60; A24F 42/10; A24D 1/22
See application file for complete search history.

(56) References Cited

U.S. PATENT DOCUMENTS 3,258,015 A 6/1966 Ellis et al.
4,714,082 A 12/1987 Banerjee et al.
(Continued)

FOREIGN PATENT DOCUMENTS

CN 1195270 A 10/1998
CN 103826482 A 5/2014
(Continued)

OTHER PUBLICATIONS

Combined Chinese Office Action and Search Report dated Jun. 3, 2020 in Chinese Patent Application No. 201680069862.7 (with English translation), citing documents AO through AQ therein, 16 pages.
(Continued)

*Primary Examiner* — Kelly M Gambetta
*Assistant Examiner* — Jennifer A Kessie
(74) *Attorney, Agent, or Firm* — Oblon, McClelland, Maier & Neustadt, L.L.P.

(57) ABSTRACT

An aerosol-generating component for an aerosol-generating article is provided, the aerosol-generating component including: a combustible heat source; an aerosol-forming substrate; and a heat-transfer element disposed between the combustible heat source and the aerosol-forming substrate, the heat-transfer element including a cup-shaped receptacle defining a cavity, and the aerosol-forming substrate forms a coating on at least a portion of an inner surface of the cup-shaped receptacle. An aerosol-generating article including the aerosol-generating component, and a method of manufacturing the aerosol-generating component are also provided.

13 Claims, 5 Drawing Sheets

(51) Int. Cl.

| | |
|---|---|
| ***A24C 5/01*** | (2020.01) |
| ***A24F 42/80*** | (2020.01) |
| ***A24D 1/22*** | (2020.01) |
| ***A24C 5/00*** | (2020.01) |
| ***B05B 11/00*** | (2023.01) |

(52) U.S. Cl.
CPC ..... *A24F 42/60* (2020.01); *A24F 42/80* (2020.01); *B05B 11/0002* (2013.01)

(56) References Cited

U.S. PATENT DOCUMENTS

| | | | | |
|---|---|---|---|---|
| 4,793,365 | A | 12/1988 | Sensabaugh, Jr. et al. | |
| 5,076,292 | A | 12/1991 | Sensabaugh, Jr. et al. | |
| 5,240,012 | A | 8/1993 | Ehrman et al. | |
| 8,061,361 | B2 | 11/2011 | Maeder et al. | |
| 2009/0151717 | A1* | 6/2009 | Bowen ..... | A61M 11/048 128/200.23 |
| 2015/0053219 | A1 | 2/2015 | Roudier et al. | |
| 2016/0100624 | A1 | 4/2016 | Yilmaz et al. | |
| 2016/0324215 | A1 | 11/2016 | Mironov et al. | |

FOREIGN PATENT DOCUMENTS

| | | | |
|---|---|---|---|
| CN | 204180943 | U | 3/2015 |
| CN | 104853628 | A | 8/2015 |
| DE | 20 2014 003 760 | U1 | 9/2014 |
| EP | 0 532 194 | A1 | 3/1993 |
| GB | 2473264 | A | 3/2011 |
| JP | 2014-217379 | A | 11/2014 |
| WO | WO 2009/022232 | A2 | 2/2009 |
| WO | WO 2013/120849 | A1 | 8/2013 |
| WO | WO 2014/086998 | A1 | 6/2014 |
| WO | WO 2014/177687 | A1 | 11/2014 |
| WO | WO 2015/022320 | A2 | 2/2015 |
| WO | WO 2015/101479 | A1 | 7/2015 |

OTHER PUBLICATIONS

International Search Report and Written Opinion dated Apr. 10, 2017 in PCT/EP2016/082118 filed Dec. 21, 2016.

Extended European Search Report dated Mar. 4, 2016 in Patent Application No. 15202621.7 citing references AC-AE and AQ therein, 8 pages.

Combined Russian Notice of Allowance and Search Report dated Mar. 11, 2020 in Chinese Patent Application No. 2018126765 (with Engiish translation), citing document AO therein, 16 pages.

Japanese Office Action dated Dec. 3, 2020 in Japanese Patent Application No. 2018-5315220 (with English translation), citing documents AO-AQ therein, 8 pages.

* cited by examiner

AEROSOL-GENERATING COMPONENT FOR USE IN AN AEROSOL-GENERATING ARTICLE

The present invention relates to an aerosol-generating component for use in an aerosol-generating article. In particular, the present invention relates to an aerosol-generating component comprising a combustible heat source and an aerosol-forming substrate. The aerosol-generating article may be a smoking article.

A number of smoking articles in which tobacco is heated rather than combusted have been proposed in the art. An aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to a physically separate aerosol-forming substrate, such as tobacco. The aerosol-forming substrate may be arranged within, around or downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user.

For example, WO-A2-2009/022232 describes a smoking article comprising a combustible heat source, an aerosol-forming substrate downstream of the combustible heat source, and a heat-conducting element around and in contact with a rear portion of the combustible heat source and an adjacent front portion of the aerosol-forming substrate. The combustible heat source and the aerosol-forming substrate are in abutting coaxial alignment and, along with the heat-conducting element, are overwrapped in an outer wrapper of cigarette paper of low air permeability to hold the various components of the smoking article together.

In smoking articles in which tobacco is heated rather than combusted, the temperature attained in the aerosol-forming substrate has a significant impact on the ability to generate a sensorially acceptable aerosol. It is, therefore, desirable to improve heat transfer from the combustible heat source to the aerosol-forming substrate. It is also desirable to retain the combustible heat source in a conductive heat exchange relationship with the aerosol-forming substrate throughout combustion of the heat source.

It would be desirable to provide an aerosol-generating component for an aerosol-generating article in which these problems were ameliorated. It would be desirable to provide an aerosol-generating component comprising a combustible heat source and an aerosol-forming substrate in which conductive heat transfer is improved. It would also be desirable to provide an aerosol-generating component in which the combustible heat source is in a close conductive heat exchange relationship with the aerosol-forming substrate.

According to a first aspect of the present invention, there is provided an aerosol-generating component for an aerosol-generating article, the aerosol-generating component comprising: a combustible heat source; an aerosol-forming substrate; and a heat-transfer element disposed between the combustible heat source and the aerosol-forming substrate. The heat-transfer element comprises a surface and the aerosol-forming substrate forms a coating on at least a portion of the surface.

According to a second aspect of the present invention, there is provided an aerosol-generating article comprising an aerosol-generating component in accordance with the first aspect of the present invention.

In use of the aerosol-generating article and the aerosol-generating component, a user may ignite the combustible heat source of the aerosol-generating component and heat the coating of aerosol-forming substrate via conductive heat transfer through the heat-transfer element. Volatile compounds may be released from the heated aerosol-forming substrate. The user may draw on an end of the aerosol-generating article to draw air into the aerosol-generating article and into the aerosol-generating component. The air drawn into the aerosol-generating component may be drawn over the heated coating of aerosol-forming substrate and volatile compounds released by the heated aerosol-forming substrate may be entrained in the airflow. The entrained volatile compounds may be drawn with the airflow out of the aerosol-generating component and be delivered to the user for inhalation.

As used herein with reference to the invention, the term 'heat-transfer element' is used to describe a means of conductive heat transfer between the combustible heat source and the aerosol-forming substrate.

In use, heat transfer in the aerosol-generating component between the combustible heat source and the aerosol-forming substrate may occur primarily by conductive heat transfer via the heat-transfer element. It is desirable to optimise the conductive heat transfer between the combustible heat source and the aerosol-forming substrate, in particular where there is little if any heating of the aerosol-forming substrate by convection.

The heat-transfer element separates the combustible heat source and the aerosol-forming substrate to substantially prevent direct contact between the combustible heat source and the aerosol-forming substrate.

The heat-transfer element may also be a substantially gas impermeable barrier. This may prevent air from being drawn along the length of the combustible heat source and may substantially prevent or inhibit combustion and decomposition products and other materials formed during ignition and combustion of the combustible heat source from coming into contact with air drawn through the aerosol-generating article and air drawn over the coating of aerosol-forming substrate.

The aerosol-forming substrate is coated on at least a portion of a surface of the heat-transfer element. Coating the aerosol-forming substrate on the heat-transfer element advantageously reduces the likelihood air gaps forming between the aerosol-forming substrate and the heat-transfer element. As a result, a greater proportion of the aerosol-forming substrate is in direct contact with the heat-transfer element. This may improve conductive heat transfer between the heat-transfer element and the aerosol-forming substrate.

Coating the aerosol-forming substrate on a surface of the heat-transfer element may also increase the ratio of the surface-area to the volume of the aerosol-forming substrate and decrease the maximum thickness of the substrate, in comparison to known plugs of aerosol-forming material. This may improve airflow over the aerosol-forming substrate and may improve aerosol output. This may reduce the quantity of aerosol-forming substrate required to generate a satisfactory aerosol.

As used herein with reference to the invention, the term 'aerosol-forming substrate' is used to describe a substrate capable of releasing volatile compounds that can form an aerosol. The volatile compounds may be released by heating the aerosol-forming substrate.

As used herein, the term 'coating' is used to describe one or more layers of material that cover and are adhered to a surface. The coating may be applied to cover and adhere to the surface of the heat-transfer element by any suitable methods known in the art including, but not limited to, spray-coating, vapour deposition, dipping, material transfer (for example, brushing or gluing), electrostatic deposition or any combination thereof. The coating may be applied to the surface of the heat-transfer element by casting. Where the coating is applied to the surface of the heat-transfer element by casting, a portion of aerosol-forming material may be applied to the surface in the form of a slurry or paste, and a punch mould or other element may apply pressure to the deposited material to form the coating by casting.

An aerosol-generating component may form part of an aerosol-generating article. The aerosol-generating article may comprise a holder and the aerosol-generating component received in the holder. The aerosol-generating component may be removably received within the holder. The aerosol-generating component may be replaceable in the holder, for example when the combustible heat source or the aerosol-forming substrate has been consumed. The holder of the aerosol-generating article may be durable and reusable.

The aerosol-generating component may be a cohesive unit. In other words, the aerosol-generating component may exist separately of an aerosol-generating article. The aerosol-generating component may be manufactured separately. The aerosol-generating component may be packaged and sold separately. The aerosol-generating component may be sold individually or in packets of aerosol-generating components to be used in conjunction with the holder.

The aerosol-generating component may be integrally formed with the aerosol-generating article. The aerosol-generating component may be wrapped together with other components of the aerosol-generating article to form a complete aerosol-generating article. The aerosol-generating component may facilitate manufacture of the aerosol-generating article.

The aerosol-generating component may be arranged along any part of the length of the aerosol-generating article. The aerosol-generating component may be arranged towards the distal end of the aerosol-generating article. The aerosol-generating component may be arranged towards an end of the aerosol-generating article substantially opposing an end comprising the mouthpiece.

The aerosol-generating article may be a smoking article.

The aerosol-generating component may be any suitable shape. The aerosol-generating component may be substantially cylindrical. The aerosol-generating component may be substantially frusto-conical. The cross-section of the aerosol-generating component may be any suitable shape. The cross-section may be substantially circular or elliptical. The cross-section may be substantially triangular or square. The aerosol-generating component may have any suitable width and length. The width of the aerosol-generating component may be between about 6 mm and about 18 mm, or between about 8 mm and about 16 mm, or about 14 mm. The length of the aerosol-generating component may be between about 10 mm and about 50 mm, or between about 15 mm and about 35 mm, or about 21 mm.

Where the aerosol-generating component is substantially circularly cylindrical, the radius of the aerosol-generating component may be between about 3 mm and about 9 mm, or between about 4 mm and about 8 mm, or about 7 mm.

The combustible heat source and the aerosol-forming substrate may be arranged in any suitable arrangement. The combustible heat source and the aerosol-forming substrate may be arranged in coaxial alignment along the longitudinal axis of the component. The heat-transfer element is arranged between the combustible heat source and the aerosol-forming substrate.

The heat-transfer element may comprise opposing first and second surfaces. The first surface may be the surface on which the aerosol-forming substrate forms a coating. The combustible heat source may contact at least a portion of the second surface. The portion of the second surface may be directly opposite the portion of the first surface on which the aerosol-forming substrate forms a coating. This may improve conductive heat transfer between the heat-transfer element and the aerosol-forming substrate.

The coating of aerosol-forming substrate on the surface of the heat-transfer element may be a solid coating. The coating may comprise a single aerosol-forming material or may comprise more than one material. The coating may comprise a single layer of aerosol-forming material or may comprise more than one layer of material. The coating may be applied to the surface of the heat-transfer element by any suitable methods known in the art including, but not limited to, spray-coating, vapour deposition, dipping, material transfer (for example, brushing or gluing), electrostatic deposition or any combination thereof. The coating may be applied as a liquid and subsequently dry to form a solid. The coating may be applied in a single application. The coating may be applied in more than one application.

The thickness of the coating may be between about 0.5 mm and about 8 mm, or between about 1 mm and about 7 mm, or about 4.5 mm.

The heat-transfer element may be comprised of non-combustible material. This may enable the heat-transfer element to covey heat from the combustible heat source to the aerosol-forming substrate without igniting the aerosol-forming substrate.

The heat-transfer element may comprise gas-resistant material. As used herein with reference to the invention, the term 'gas-resistant' is used to describe a material that is at least substantially impermeable to gas. This may enable the heat-transfer element to substantially prevent or inhibit combustion and decomposition products and other materials formed during ignition and combustion of the combustible heat source from coming into contact with air drawn over the coating of aerosol-forming substrate.

The heat-transfer element may comprise one or more air inlets. The one or more air inlets may be arranged to promote airflow over the aerosol-forming substrate. The one or more air inlets may be arranged to promote airflow over the combustible heat source and to encourage ignition and sustained combustion of the combustible heat source. The combustible heat source may comprise one or more passages extending into the combustible heat source from the air inlets. These passages may increase the surface area of the combustible heat source and enable the combustible heat source to receive more air to support ignition and sustained combustion.

The one or more air inlets may be any suitable shape. The one or more air inlets may be substantially circular or elliptical. The one or more air inlets may be substantially rectangular.

The diameter of the one or more air inlets may be between about 1.5 mm and about 3 mm, or between about 2 mm and about 2.5 mm.

The heat-transfer element may comprise heat-conductive material. As used herein with reference to the invention, the term 'heat-conductive material' is used to describe a material having a thermal conductivity of between about 50

W/m·K and about 300 W/m·K. The heat-transfer element may be formed of a single piece of material. The heat-transfer element may be formed from a single piece of heat-conductive material. As used herein with reference to the invention, a single piece of material means an integrally formed body of material. A single piece of material may include a body of laminated material. Single piece construction may facilitate manufacture of a cavity having a surface suitable for coating. Single piece construction may facilitate manufacture of the heat-transfer element as a substantially gas impermeable barrier. The heat-transfer element may be formed of more than one piece of heat-conductive material. The heat-transfer element may be formed of more than one heat-conductive material.

The heat-transfer element may be comprised of metal, such as aluminium, steel, iron or a metal alloy. The heat-transfer element may comprise aluminium. The heat-transfer element may be comprised of polymeric material, such as any suitable polymer capable of withstanding the operating temperature of the combustible heat source. The heat-transfer element may be comprised of a ceramic material. The heat-transfer element may be comprised of a combination of materials or types of material, for example a combination of metal and ceramic material.

The heat-transfer element may be thin. In other words, the heat-transfer element may have a thickness that is substantially smaller than the other dimensions of the heat-transfer element. The heat-transfer element may have a consistent thickness across the element. The thickness of the heat-transfer element may vary across the element. The thickness of the heat-transfer element may be between about 0.05 mm and about 0.5 mm or between about 0.2 mm and about 0.4 mm, or about 0.3 mm.

The heat-transfer element may be any suitable shape. The heat-transfer element may be substantially planar. In other words, the heat-transfer element may extend substantially in a single plane. The heat-transfer element may be non-planar. The heat-transfer element may comprise non-planar portions.

The heat-transfer element may comprise a cup-shaped receptacle. The cup-shaped receptacle of the heat-transfer element may define a cavity. The cup-shaped receptacle may comprise an inner surface that defines the cavity. The cavity may be open at one end. The aerosol-forming substrate may form a coating on at least a portion of an inner surface of the cup-shaped receptacle. In other words, the aerosol-forming substrate may form a coating on at least a portion of an inner surface of the cavity.

In some embodiments, the cup-shaped receptacle may comprise an outer surface that opposes the inner surface of the cup-shaped receptacle. Where the aerosol-forming substrate forms a coating on at least a portion of an inner surface of the cup-shaped receptacle, the combustible heat source may contact an opposing portion of an outer surface of the cup-shaped receptacle. This may improve conductive heat transfer between the combustible heat source and the aerosol-forming substrate.

In other embodiments, the combustible heat source may contact at least a portion of an inner surface of the cup-shaped receptacle. Where the combustible heat source contacts at least a portion of an inner surface of the cup-shaped receptacle, the aerosol-forming substrate may form a coating on an opposing portion of an outer surface of the cup-shaped receptacle. This may improve conductive heat transfer between the combustible heat source and the aerosol-forming substrate.

The heat-transfer element may comprise a shell defining the cavity. As used herein with reference to the invention, the terms 'cup-shaped receptacle' and 'shell' are used interchangeably. The terms 'cup-shaped receptacle' and 'shell' are used to describe a receptacle having a cavity suitable for containing an aerosol-forming substrate. An inner surface of the cavity may be suitable for coating with an aerosol-forming material. The heat-transfer element may comprise the cup-shaped receptacle alone. The heat-transfer element may comprise the cup-shaped receptacle and additional parts or portions.

The cup-shaped receptacle may be any suitable size and shape. The cup-shaped receptacle may be substantially cylindrical or tubular. The cup-shaped receptacle may have any suitable cross-section. The cross-section of the cup-shaped receptacle may be substantially circular or elliptical. The cross-section may be substantially triangular, square, hexagonal or any other shape comprising any number of sides.

The cup-shaped receptacle may comprise a base portion and at least one side wall extending from the base portion. The sidewall may circumscribe the base portion. The base portion may substantially close one end of the cup-shaped receptacle. The base and sidewall may be integrally formed. The end of the cup-shaped receptacle opposite the base may be open to enable airflow to enter and exit the cavity. The base portion may be substantially circular. The sidewall may be substantially cylindrical. The cup-shaped receptacle may be formed of a single piece of material. The cup-shaped receptacle may be formed of a single piece of heat-conductive material.

Where the cup-shaped receptacle is substantially circularly cylindrical, the radius of the base of the cup-shaped receptacle may be between about 3 mm and about 9 mm, or between about 4 mm and about 8 mm or about 7 mm, and the length of the cup-shaped receptacle may be between about 7 mm and about 17 mm, or between about 8 mm and about 15 mm, or about 10 mm. The radius of the cavity may be between about 2.5 mm and about 8.9 mm, or about 3 mm and about 7 mm, or about 13.4 mm.

Where the heat-transfer element comprises one or more air inlets, the cup-shaped receptacle may be provided with at least one air inlet. This may improve airflow into and out of the cavity. The at least one air inlet may be provided on a sidewall of the cup-shaped receptacle. The at least one air inlet may be provided towards the open end of the cup-shaped receptacle. The at least one air inlet may be provided at least about two thirds or 70% of the length of the cup-shaped receptacle away from the base. The at least one air inlet may be provided on a sidewall of the cup-shaped receptacle.

The thickness of the cup-shaped receptacle may be the same as other sections of the heat-transfer element. The thickness of the cup-shaped receptacle may be the same as all of the other sections of the heat-transfer element. The thickness of the cup-shaped receptacle may be less than the thickness of other sections of the heat-transfer element. The thickness of the base of the cup-shaped receptacle may be less than the thickness of the sidewalls of the cup-shaped receptacle. Providing a thin-walled cup-shaped receptacle or a thin-walled base may improve conductive heat transfer between the combustible heat source and the aerosol-forming substrate. In addition, providing a thin walled cup-shaped receptacle or a thin-walled base may reduce the thermal mass of the cup-shaped receptacle, and thus may reduce the time required to heat the cup-shaped receptacle to the operating temperature.

Where the heat-transfer element forms a cavity, the aerosol-substrate may be at least partially contained in the cavity. The aerosol-forming substrate may fill the cavity. The thickness of the coating of aerosol-forming substrate may be no more than 80% of the width of the cavity. This provides a recess extending into the cavity from the open end that is bounded by aerosol-forming substrate. The recess may increases the ratio of surface area to volume of the aerosol-forming substrate.

The coating of aerosol-forming substrate may extend over the entire inner surface of the cup-shaped receptacle. Alternatively, the coating may extend over a portion of the inner surface of the cup-shaped receptacle. A portion of the inner surface of the cup-shaped receptacle may be left uncoated, for example, to enable air inlets to remain uncovered to enable air to pass through the inlets. The coating may extend over the inner surface of the base and about two thirds or 70% of the inner surface of the side wall of the cup-shaped receptacle. The coating may be porous.

The cavity may comprise an open end that may be closed with a lid. The lid may be removably securable to the heat-transfer element. Closing the cavity with a lid may reduce ingress of moisture and atmospheric air into the cavity. Where the cup-shaped receptacle comprises one or more air inlets, the lid may extend over the one or more air inlets to close the cavity. Where the cavity contains the aerosol-forming substrate, closing the cavity with a lid may preserve the volatile compounds of the aerosol-forming substrate within the aerosol-forming substrate and maintain the flavour of the aerosol-forming substrate. Where the cavity contains the combustible heat source, closing the cavity with a lid may preserve the moisture content of the combustible heat source and promote ignition and combustion of the heat source.

The lid may be a cap covering the open end of the cup-shaped receptacle. The lid may be secured on the open end of the cup-shaped receptacle by any suitable means. The lid may be secured on the open end of the cup-shaped receptacle by a friction or interference fit. The lid may be secured on the open end of the cup-shaped receptacle by a screw thread connection. The cap and the open end of the cup-shaped receptacle may be provided with complimentary male and female screw threads.

The lid may be sealed to the cup-shaped receptacle to form a sealed cavity. The seal may be substantially airtight. The seal may be hermetic. The lid may be sealed to the cup-shaped receptacle of the capsule using any suitable method, including but not limited to: adhesive, such as an epoxy adhesive; heat sealing; ultrasonic welding; and laser welding.

The lid may be removable from the cup-shaped receptacle to allow air to flow into and out of the capsule. The lid may be removable by pulling or peeling or twisting. The lid may be provided with a tab for a user to grip to facilitate removal.

The lid may be non-removable from the cup-shaped receptacle. The lid may be piercable. The lid may be configured to be pierced before or on being received by the holder of the aerosol-generating article.

The lid may be made from any suitable material or combination of materials. The lid may comprise a polymer. The lid may comprise a metal. The lid may comprise aluminium, in particular laminated, food grade, anodized aluminium. The lid may be laminated to improve sealability. The lid may be comprised of a laminated composite film comprising at least a polymer layer and a metallic layer. The polymer layer may be arranged to be heat welded onto the heat-transfer element to seal the cavity. The metallic layer may facilitate an airtight or hermetic seal. Where air inlets are provided in the cup-shaped receptacle, the lid may extend over the air inlets. Extending the lid over the air inlets may facilitate the formation of a sealed cavity.

The heat-transfer element may form two opposing cavities, a first cavity and a second cavity. The aerosol-forming substrate may form a coating on at least a portion of an inner surface of the first cavity. The combustible heat source may contact at least a portion of an inner surface of the second cavity. This arrangement may improve conductive heat transfer between the combustible heat source and the aerosol-forming substrate.

Where the heat-transfer element comprises two opposing cavities, the heat-transfer element may comprise a first cup-shaped receptacle comprising the first cavity and a second cup-shaped receptacle comprising the second cavity. The first cup-shaped receptacle may comprise a base portion and at least one sidewall forming the cavity. The second cup-shaped receptacle may comprise a base portion and at least one sidewall forming the second cavity. The first cup-shaped receptacle and the second cup-shaped receptacle may share a common base portion.

The second cup-shaped receptacle may be integrally formed with the first cup-shaped receptacle. The second cup-shaped receptacle may be formed separately to the first cup-shaped receptacle and attached or secured to the first cup-shaped receptacle.

The second cup-shaped receptacle may be substantially similar to the first cup-shaped receptacle, having similar shape and dimensions. The side wall of the second cup-shaped receptacle may have a length that is shorter or longer than that of the first cup-shaped receptacle.

The second cavity may contain a portion of the combustible heat source. The second cavity may contain all of the combustible heat source. Where the second cavity contains all of the combustible heat source, the side wall may extend beyond a rear end face of the combustible heat source.

The second cup-shaped receptacle may secure the combustible heat source to the heat-transfer element. The second cup-shaped receptacle may be the securing means to secure the combustible heat source to the heat-transfer element. The second cup-shaped receptacle may be a part of the securing means. The second cup-shaped receptacle may improve the mechanical attachment of the combustible heat source to the heat-transfer element.

The first cup-shaped receptacle may comprise one or more air inlets. The second cup-shaped receptacle may comprise one or more air inlets. Both the first cup-shaped receptacle and the second cup-shaped receptacle may comprise air inlets.

The heat-transfer element may have any combination of protrusions, recesses and cavities.

At least one of the first cavity and the second cavity may be closed with a lid.

The combustible heat source may be secured to the heat-transfer element. Securing the combustible heat source to the heat-transfer element may sustain contact between the combustible heat source and the heat-transfer element throughout combustion of the heat source. This may improve conductive heat transfer between the combustible heat source and the heat-transfer element. This may also enable the temperature of the aerosol-forming substrate to be maintained within a desired range throughout combustion of the combustible heat source.

Securing the combustible heat source to the heat-transfer element may also facilitate formation of the aerosol-generating component as a cohesive unit. In other words, securing the combustible heat source to the heat-transfer element may facilitate the existence of the aerosol-generating component separately of the aerosol-generating article.

The combustible heat source may be secured to the heat-transfer element by securing means. The securing means may be a mechanical securing means. The securing means may be bonding means, such as an adhesive or bonding material. The securing means may comprise one means or may comprise more than one means. The securing means may comprise both mechanical securing means and bonding means.

The heat-transfer element may comprise one or more protrusions. The one or more protrusions may extend at least one of towards and away from the combustible heat source. The aerosol-forming substrate may form a coating on at least a portion of a surface of the one or more protrusions. The one or more protrusions may extend into the combustible heat source. The one or more protrusions may be at least partially surrounded by the combustible heat source. The combustible heat source may contact at least a portion of a surface of the one or more protrusions. The one or more protrusions may increase the surface area of the heat-transfer element. This may improve conductive heat transfer between the combustible heat source and the heat-transfer element.

The one or more protrusions may be the securing means for securing the combustible heat source to the heat-transfer element. The one or more protrusions may be a part of the securing means. The one or more protrusions may improve the mechanical attachment of the combustible heat source to the heat-transfer element.

The one or more protrusions may be attached to the heat-transfer element. The one or more protrusions may be integrally formed with the heat-transfer element. The one or more protrusions may be comprised of the same material as the cup-shaped receptacle. The one or more protrusions may be comprised of different material to the cup-shaped receptacle. The one or more protrusions may be comprised of metal, such as aluminium, steel, iron or a metal alloy. The one or more protrusions may comprise aluminium. The one or more protrusions may be comprised of polymeric material, such as any suitable polymer capable of withstanding the operating temperature of the combustible heat source. The one or more protrusions may be comprised of a ceramic material. The one or more protrusions may be comprised of a combination of materials or types of material, for example a combination of metal and ceramic material.

The one or more protrusions may be solid. The one or more protrusions may be hollow. Where the heat-transfer element forms a cavity, the cavity may extend into the one or more protrusions. The aerosol-forming substrate may form a coating on a portion of the inner surface of the cup-shaped receptacle that extends into the one or more protrusions.

The one or more protrusions may be any suitable shape. The one or more protrusions may be elongate. The one or more protrusions may extend substantially coaxially with the aerosol-generating component. The one or more protrusions may extend substantially linearly. The one or more protrusions may extend substantially non-linearly. The one or more protrusions may be any suitable shape. The cross-sectional shape of the one or more protrusion may be substantially circular or elliptical. The cross-sectional shape of the one or more protrusions may be triangular or square or any other suitable shape.

The one or more protrusions may extend from any section of the heat-transfer element. The one or more protrusions may extend from the cup-shaped receptacle. The one or more protrusions may extend from the base of the cup-shaped receptacle. The one or more protrusions may extend towards or away from the combustible heat source by any suitable distance. The one or more protrusions may extend into the combustible heat source to about two thirds or 70% of the length of the combustible heat source. The one or more protrusions may extend to or beyond a front end face of the combustible heat source.

The width of the one or more protrusions may be between about 1 mm and about 30 mm, or between about 1.4 mm and about 26 mm, or about 20 mm. The length of the one or more protrusions may be between about 1 mm and about 20 mm, or about 3 mm and about 15 mm, or about 10 mm.

The one or more protrusion may comprise one or more bulbous portions, flared portions or flanges at any point along its length. The one or more bulbous portions, flared portions or flanges may be arranged towards the distal end of the protrusion. The one or more bulbous portions, flared portions or flanges may extend from any position on the one or more protrusions. The one or more bulbous portions, flared portions or flanges may extend from towards the distal end of the one or more protrusions. The one or more bulbous portions, flared portions or flanges may form a barb, extending in a direction substantially opposite to the direction of the one or more protrusions. The one or more bulbous portions, flared portions or flanges may improve mechanical attachment of the combustible heat source to the heat-transfer element.

Where the heat-transfer element comprises a cavity, the one or more protrusions may extend into or away from the cavity. Where the protrusion extends away from the cavity, the cavity may extend into the protrusion. Where the cavity extends into the protrusion, the aerosol-forming substrate may form a coating on at least a portion of the inner surface of the cup-shaped receptacle that extends into the protrusion. This may improve conductive heat transfer between the aerosol-forming substrate and the heat-transfer element.

Where the heat-transfer element comprises a cavity, the heat-transfer element may comprise one or more recesses extending into the cavity. The combustible heat source may extend at least partially into the one or more recesses. This may improve conductive heat transfer from the combustible heat source to the aerosol-forming substrate.

The one or more recesses may be any suitable shape. The one or more recesses may have a substantially circular or elliptical cross-section. The one or more recesses may have a substantially triangular or square cross-section. The ratio of the radius of the base to the radius of the one or more recesses may be between about 1.5 and about 4.0. The length of the recess may be between at least about ½ and about ¾ of the length of the side wall of the cup-shaped receptacle. This may improve conductive heat transfer from the combustible heat source to the aerosol-forming substrate.

The heat-transfer element may comprise one or more protrusions or one or more recesses. The heat-transfer element may comprise both one or more protrusions and one or more recesses.

The heat-transfer element may be connected to other components of the aerosol-generating article. The heat-transfer element may be releasably connected to other components of the aerosol-generating article.

The heat-transfer element may be connected to other components of the aerosol-generating article by connecting means. The connecting means may be a releasable connecting means. The connecting means may comprise one half of a connector. The heat-transfer element may have a male or female connector portion configured to be complimentary to an opposing female or male connector of other components of the aerosol-generating article. The heat-transfer element may comprise a threaded portion having one of a male and female screw thread configured to be complimentary to an opposing female or male thread of other components of the aerosol-generating article. The connecting means may comprise a lip configured to be grasped by a clip of other components of the aerosol-generating article.

The aerosol-generating article may be connected to other components of the aerosol-generating article by a wrapper. The wrapper may extend over the entire length of the aerosol-generating component. The wrapper may extend over the heat-transfer element of the aerosol-generating component. The wrapper may extend up to but not over the combustible heat source.

The combustible heat source may comprise any suitable combustible fuel. The combustible heat source may be solid. The combustible heat source may be carbonaceous. The combustible heat source may comprise components such as binders and ignition aids.

The combustible heat source may be any suitable shape. The combustible heat source may be substantially cylindrical. The cross-section of the cylindrical combustible heat source may be substantially circular or elliptical. The combustible heat source may be substantially frusto-conical.

The width of the combustible heat source may be between about 6 mm and about 40 mm, or between about 10 mm and about 30 mm or about 20 mm. The length of the combustible heat source may be between about 5 mm and about 20 mm, or about 8 mm and about 15 mm, or about 10 mm.

The combustible heat source may be a blind combustible heat source. As used herein with reference to the invention, the term 'blind' describes a heat source that does not comprise any air flow channels extending from the front end face to the rear end face of the combustible heat source. As used herein with reference to the invention, the term 'blind' is also used to describe a combustible heat source including one or more airflow channels extending from the front end face of the combustible heat source to the rear end face of the combustible heat source, wherein a substantially air impermeable barrier, such as the heat-transfer element, between the rear end face of the combustible heat source and the aerosol-forming substrate prevents air from being drawn along the length of the combustible heat source through the one or more airflow channels.

Aerosol-generating articles according to the present invention comprising blind combustible heat sources may comprise one or more air inlets downstream of the rear end face of the combustible heat source for drawing air into the one or more airflow pathways.

The aerosol-generating article may comprise a blind combustible heat source comprising one or more air inlets. The one or more air inlets may be arranged proximate to the downstream end of the aerosol-forming substrate.

In use, air for inhalation by a user that is drawn along the one or more airflow pathways of aerosol-generating articles according to the present invention comprising a blind combustible heat source does not pass through any airflow channels along the blind combustible heat source. The lack of any airflow channels through the blind combustible heat source may prevent or inhibits activation of combustion of the blind combustible heat source during puffing by a user. This may prevents or inhibits spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be avoided. In addition, the impact of a user's puffing regime on the composition of the mainstream aerosol may be minimised or reduced.

The inclusion of a blind combustible heat source may substantially prevent or inhibit combustion and decomposition products and other materials formed during ignition and combustion of the blind combustible heat source from entering air drawn through aerosol-generating articles according to the present invention during use thereof. This is advantageous where the blind combustible heat source comprises one or more additives to aid ignition or combustion of the blind combustible heat source.

In aerosol-generating articles according to the present invention comprising a blind combustible heat source, heat transfer from the blind combustible heat source to the aerosol-forming substrate occurs primarily by conduction and heating of the aerosol-forming substrate by forced convection is minimised or reduced. This may help to minimise or reduce the impact of a user's puffing regime on the composition of the mainstream aerosol of aerosol-generating articles according to the present invention.

In aerosol-generating articles according to the present invention comprising a blind combustible heat source, it is important to optimise the conductive heat transfer between the combustible heat source and the aerosol-forming substrate, where there is little if any heating of the aerosol-forming substrate by forced convection.

Aerosol-generating articles according to the present invention may comprise blind combustible heat sources comprising one or more closed or blocked passageways through which air may not be drawn for inhalation by a user. The one or more closed passageways may be closed by combustible heat source material. The one or more closed passageways may be closed by the heat-transfer element. The heat-transfer element may be arranged to block or obscure the one or more passageways.

For example, aerosol-generating articles according to the present invention may comprise blind combustible heat sources comprising one or more closed passageways that extend from the front end face at the upstream end of the blind combustible carbonaceous heat source only part way along the length of the blind combustible carbonaceous heat source.

The inclusion of one or more closed air passageways increases the surface area of the blind combustible heat source that is exposed to oxygen from the air and may facilitate ignition and sustained combustion of the blind combustible heat source.

The combustible heat source may comprise at least one longitudinal airflow channel, which provides one or more airflow pathways through the heat source. The term 'airflow channel' is used herein to describe a channel extending along the length of the heat source through which air may be drawn through the aerosol-generating article for inhalation by a user. Such heat sources including one or more longitudinal airflow channels are referred to herein as 'non-blind' heat sources.

The diameter of the at least one longitudinal airflow channel may be between about 1.5 mm and about 3 mm, or between about 2 mm and about 2.5 mm. The inner surface of the at least one longitudinal airflow channel may be partially or entirely coated, as described in more detail in WO-A-2009/022232.

Aerosol-generating articles according to the present invention comprising non-blind combustible heat sources may also comprise one or more air inlets downstream of the rear end face of the combustible heat source for drawing air into the one or more airflow pathways.

Where the combustible heat source is a non-blind combustible heat source and comprises one or more longitudinal airflow channels, the heat-transfer element may comprise one or more air inlets arranged to align with the one or more longitudinal airflow channels. The heat-transfer element may be shaped such that the one or more longitudinal airflow passages of the combustible heat source are substantially not obstructed by the heat-transfer element.

In use, ambient air may be drawn through the one or more longitudinal airflow channels of the combustible heat source, past the heat-transfer element and over the aerosol-forming substrate.

The aerosol-forming substrate is a substrate capable of releasing volatile compounds that can form an aerosol. The volatile compounds may be released by heating the aerosol-forming substrate.

The aerosol-forming substrate may be a solid, a liquid or comprise both solid and liquid components. The aerosol-forming substrate may be solid. The aerosol-forming substrate may comprise tobacco. The aerosol-forming substrate may comprise a slurry. The aerosol-forming substrate may comprise a slurry comprising tobacco. The aerosol-forming substrate may be applied to the inner surface of the cup-shaped receptacle as a liquid. The aerosol-forming substrate may dry to form a solid coating.

The aerosol-forming substrate may comprise nicotine. The nicotine containing aerosol-forming substrate may be a nicotine salt matrix. The aerosol-forming substrate may comprise plant-based material.

The aerosol-forming substrate may comprise tobacco containing material. The tobacco containing material may contain volatile tobacco flavour compounds, which are released from the aerosol-forming substrate upon heating. The aerosol-forming substrate may comprise homogenised tobacco material.

Homogenised tobacco material may be formed by agglomerating particulate tobacco. Where present, the homogenised tobacco material may have an aerosol-former content of equal to or greater than 5% on a dry weight basis, and may be between greater than 5% and 30% by weight on a dry weight basis.

The aerosol-forming substrate may alternatively comprise a non-tobacco-containing material. The aerosol-forming substrate may comprise homogenised plant-based material.

The aerosol-forming substrate may comprise at least one aerosol-former. The aerosol-former may be any suitable known compound or mixture of compounds that, in use, facilitates formation of a dense and stable aerosol and that is substantially resistant to thermal degradation at the combustion temperature of the combustible heat source. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may include polyhydric alcohols or mixtures thereof, such as triethylene glycol, 1,3-butanediol and glycerine.

The aerosol-forming substrate may comprise other additives and ingredients, such as flavourants.

The aerosol-forming substrate may comprise nicotine and at least one aerosol-former. The aerosol-former may be glycerine. The improved arrangement of combustible heat source, heat-transfer element and aerosol-forming substrate may increase the operating temperature of the aerosol-forming substrate. The higher operating temperature may enable glycerine to be used as an aerosol-former. This may provide an improved aerosol as compared to the aerosol-formers used in other known aerosol-generating articles.

An aerosol-generating article comprising an aerosol-generating component in accordance with the first aspect of the present invention may benefit from all of the advantages of the aerosol-generating component. The aerosol-generating component may also facilitate manufacture of the aerosol-generating article.

An aerosol-generating article according to the present invention may have any desired length. For example, the aerosol-generating article may have a total length of between about 65 mm and about 100 mm. The aerosol-generating article may have any desired external diameter. For example, the aerosol-generating article may have an external diameter of between about 6 mm and about 35 mm.

The aerosol-generating component may be arranged at any position along the length of the aerosol-generating article. The aerosol-generating component may be arranged towards the distal end of the aerosol-generating article.

The aerosol-generating article may comprise a holder for receiving the aerosol-generating component. The aerosol-generating component may be removably received in the holder. The aerosol-generating article may comprise connecting means for securing the aerosol-generating component to the holder. The connecting means may be a complimentary part of a connector as described above in respect of the connecting means of the aerosol-generating component.

The holder may be configured for multiple uses. The holder may be durable. The holder may be reusable. The holder may be any shape. The holder may be elongate. The holder may comprise a housing having a cavity for receiving the aerosol-generating component. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. The material may be light and non-brittle.

The holder may comprise a mouthpiece. The mouthpiece may comprise at least one air inlet and at least one air outlet. The air inlets may reduce the temperature of the aerosol before it is delivered to a user through the mouthpiece.

The aerosol-generating component may be non-removably secured to other components of the aerosol-generating article. For example, a wrapper may non-removably secure the aerosol-generating component to other components of the aerosol-generating article. The wrapper may circumscribe at least a portion of the aerosol-generating component to non-removably secure the aerosol-generating component to other components of the aerosol-generating article. Aerosol-generating articles according to the present invention may be assembled using known methods and machinery.

The aerosol-generating article may be a smoking article.

The smoking article may be portable. The smoking article may have a size comparable to a conventional cigar or cigarette. The smoking article may have a total length between about 30 mm and about 150 mm. The smoking article may have an external diameter between about 5 mm and about 30 mm. The holder may further comprise a mouthpiece having an air outlet and optionally one or more air inlets.

As used herein with reference to the invention, the terms 'longitudinal' and 'axial' are used to describe the direction between the proximal end and opposed distal end of the aerosol-generating component and the proximal end and the opposed distal end of the aerosol-generating article.

As used herein with reference to the invention, the terms 'radial' and 'transverse' are used to describe the direction perpendicular to the longitudinal direction. That is, the direction perpendicular to the direction between the proximal end and the opposed distal end of the aerosol-generating component and the proximal end and the opposed distal end of the aerosol-generating article.

As used herein with reference to the invention, the terms "inner surface" and "outer surface" refer to the radially inner and radially outer surfaces, respectively, of parts or portions of parts of the aerosol-generating component or the aerosol-generating article.

As used herein with reference to the invention, the terms 'proximal', 'downstream' and 'rear', are used to describe the relative positions of parts, or portions of parts, of aerosol-generating components towards the aerosol-forming substrate containing end of the aerosol-generating component and the mouthpiece comprising end of the aerosol-generating article.

As used herein with reference to the invention, the terms 'distal', 'upstream' and 'front', are used to describe the relative positions of parts, or portions of parts, of aerosol-generating components towards the combustible heat source end and the opposing end to the mouthpiece end of the aerosol-generating article.

As used herein with reference to the invention, the term 'length' is used to describe the maximum dimension in the longitudinal direction of the aerosol-generating component or the aerosol-generating article. That is, the maximum dimension in the direction between the proximal end and the opposed distal end of the aerosol-generating component and the proximal end and the opposed distal end of the aerosol-generating article.

As used herein with reference to the invention, the term 'width' denotes the maximum dimension in the transverse direction of parts or portions of parts of the aerosol-generating component or the aerosol-generating article.

As used herein with reference to the invention, the term 'diameter' denotes the maximum dimension in the transverse direction of parts or portions of parts of the aerosol-generating component or the aerosol-generating article and the term 'radius' denotes half the maximum dimension in the transverse direction. According to a third aspect of the present invention, there is provided a method of manufacturing an aerosol-generating component in accordance with the first aspect of the present invention, wherein the method comprises: positioning a portion of combustible material with respect to a portion of heat-conductive material; pressing the heat-conductive material and the combustible material together to form the combustible heat source and the heat-transfer element comprising the cup-shaped receptacle having the cavity; and applying a coating of an aerosol-forming material to a least a portion of the inner surface of the cup-shaped receptacle to form the aerosol-forming substrate.

According to a fourth aspect of the present invention, there is provided a method of manufacturing an aerosol-generating component in accordance with the first aspect of the present invention, wherein the method comprises: forming a web of heat-conductive material into a predetermined shape to form the heat-transfer element having opposing first and second surfaces; applying a coating of an aerosol-forming material to at least a portion of the first surface to form the aerosol-forming substrate; and applying a portion of combustible material to at least a portion of the second surface to form the combustible heat source.

The coating of aerosol-forming material may be applied to the heat-conductive material before the portion of combustible material is applied to the heat-conductive material. The portion of combustible material may be applied to the heat-conductive material before the coating of aerosol-forming material is applied to the heat-conductive material. The aerosol-forming material and the heat-conductive material may be applied to the heat-conductive material at the same time.

According to a fifth aspect of the present invention, there is provided a method of manufacturing an aerosol-generating component in accordance with a first aspect of the present invention, where the heat-transfer element forms a cavity, wherein the method comprises:

pressing a portion of combustible material to form the combustible heat source, the combustible heat source having a cavity; pressing a web of heat-conductive material onto the combustible heat source such that heat-conductive material lines the cavity of the combustible heat source to form the heat-transfer element and the cavity; and applying a coating of an aerosol-forming material to a least a portion of an inner surface of the cup-shaped receptacle to form the aerosol-forming substrate.

All scientific and technical terms used herein have meanings commonly used in the art unless otherwise specified. The definitions provided herein are to facilitate understanding of certain terms used frequently herein.

Features described in relation to one aspect of the present invention may also be applicable to other aspects of the present invention. In particular, method aspects may be applied to apparatus aspects, and vice versa. Any, some or all features in one aspect can be applied to any, some or all features in any other aspect, in any appropriate combination. It should also be appreciated that particular combinations of the various features described and defined in any aspects of the invention can be implemented, supplied or used independently.

The invention will be further described, by way of example only, with reference to the accompanying drawings in which.

Figure 1:
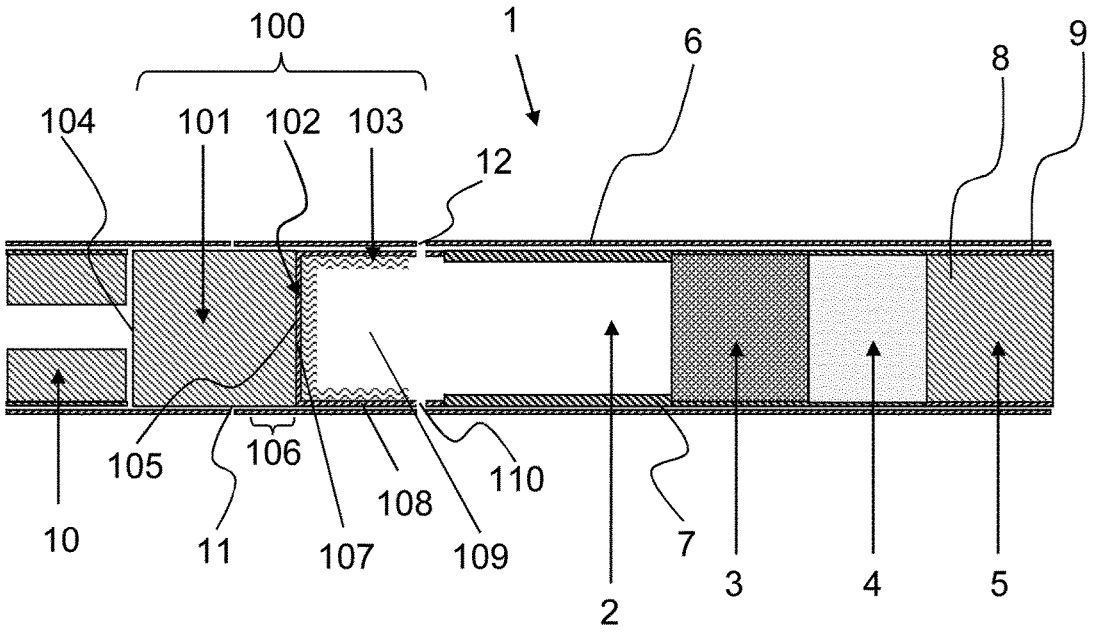
FIG. 1 shows a cross-sectional view of a first embodiment of an aerosol-generating article according to the present invention comprising a first embodiment of an aerosol-generating component according to the present invention.

An aerosol-generating article 1 according to a first embodiment of the invention is shown in FIG. 1. The aerosol-generating article 1 comprises an aerosol-generating component 100, a transfer element 2, an aerosol-cooling element 3, a spacer element 4 and a mouthpiece 5 in abutting coaxial alignment.

The aerosol-generating component 100 comprises a combustible heat source 101, a heat-transfer element 102 and an aerosol-forming substrate 103. As shown in FIG. 1, the aerosol-generating component 100 is generally circularly cylindrical with a radius of about 7 mm and a length of about 21 mm.

The combustible heat source 101 is a blind heat source. The combustible heat source 101 comprises a substantially circularly cylindrical body of combustible, carbonaceous material. The combustible heat source has a radius of about 7 mm and a length of about 10 mm. The combustible heat source 101 has a front end face 104 and an opposing rear end face 105.

As shown in FIG. 1, the aerosol-generating component 100, transfer element 2, aerosol-cooling element 3, spacer element 4 and mouthpiece 5 are wrapped in an outer wrapper 6 of sheet material such as, for example, cigarette paper. In use, the outer wrapper 6 only partially extends over the aerosol-generating component 100. The outer wrapper 6 extends over the heat-transfer element 102 and a rear portion 106 of the combustible heat source 101.

The heat-transfer element 101 is formed of a sheet of aluminium foil having a thickness of about 0.3 mm. The heat-transfer element 101 forms a receptacle that is generally cup-shaped and comprises a substantially circular base 107 and a substantially cylindrical side wall 108, extending from the base 107 and circumscribing the base 107. The radius of the base 107 is about 7 mm and the length of the side wall 108 is about 10 mm. As shown in FIG. 1, the base 107 and side wall 108 define a substantially circularly cylindrical cavity 109. One or more circumferential air inlets 110 are provided in the side wall 108 of the cup-shaped receptacle towards the open end of the cavity 109.

The heat-transfer element 102 is applied to the rear end face 105 of the combustible heat source 101 by pressing an outer surface the base 107 of the cup-shaped receptacle onto the rear end face 105 of the combustible heat source 101.

As shown in FIG. 1, the aerosol-forming substrate 103 forms a coating on the inner surface of the cup-shaped receptacle, in the cavity 109. The thickness of the coating is about 4.5 mm.

The aerosol-forming substrate 103 comprises tobacco and an aerosol-former such as, for example, glycerine. The aerosol-forming substrate 103 is applied to the inner surface of the cup-shaped receptacle, in the cavity 109, to form a coating by spraying the inner surface of the cup-shaped receptacle with a slurry comprising the tobacco and aerosol former. The slurry dries to form a solid coating of the aerosol-forming substrate 103 on the inner surface of the cup-shaped receptacle. It will be appreciated that the aerosol-forming substrate may be applied to the inner surface of the cup-shaped receptacle by other suitable methods known in the art.

The coating of aerosol-forming substrate 103 extends over the base 107 and partially over the side wall 108, towards the open end of the cavity 109. The coating of aerosol-forming substrate 103 extends from the base 107 over the sidewall 108 towards the open end to about two thirds or 70% of the length of the side wall 108 that is about 6.5 mm. As shown in FIG. 1, the coating of aerosol-forming substrate 103 does not extend as far as the plurality of air inlets 110 provided in the side wall 108 of the cup-shaped receptacle. This enables air to enter the cavity 109 via the air inlets 110.

As shown in FIG. 1, the heat-transfer element 101 is disposed between the rear end face 105 of the combustible heat source 101 and the aerosol-forming substrate 103. The heat-transfer element 102 forms a non-combustible, substantially air impermeable barrier between the combustible heat source 101 and the aerosol-forming substrate 103. As a result, in use, combustion and decomposition products and other materials formed during ignition and combustion of the combustible heat source 101 are substantially prevented or inhibited from entering air drawn into the cavity 109, via air inlets 12, 110.

The transfer element 2 of the aerosol-generating article 1 is arranged immediately downstream of the aerosol-generating component 100, and comprises a cylindrical open-ended hollow cellulose acetate tube 7.

The aerosol-cooling element 3 is arranged immediately downstream of the transfer element 2, and comprises a gathered sheet of biodegradable polymeric material such as, for example, polylactic acid.

The spacer element 4 is arranged immediately downstream of the aerosol-cooling element 3, and comprises a cylindrical open-ended hollow tube formed of, for example, paper or cardboard.

The mouthpiece 5 is arranged immediately downstream of the spacer element 4. As shown in FIG. 1, the mouthpiece 5 is arranged at the opposite end of the aerosol-generating article 1 to the aerosol-generating component 100. The mouthpiece 5 comprises a cylindrical plug of suitable filtration material 8 such as, for example, cellulose acetate tow of very low filtration efficiency, wrapped in filter plug wrap 9.

The aerosol-generating article 1 may further comprise a band of tipping paper (not shown) circumscribing a downstream end portion of the outer wrapper 6.

The aerosol-generating article 1 further comprises an optional, removable protective cap 10 at the distal end. As shown in FIG. 1, the removable cap 10 is arranged directly adjacent to the aerosol-generating component 100. The removable cap 10 comprises a central portion including a desiccant such as, for example, glycerine, to absorb moisture. The central portion is wrapped in a portion of the outer wrapper 6 that is connected to the remainder of the outer wrapper 6 along a line of weakness 11. The line of weakness 11 comprises a plurality of perforations in the outer wrapper 6 that circumscribe the aerosol-generating article 1.

To use the aerosol-generating article 1, a user removes the removable cap 10 by transversely compressing the cap by pinching it between their thumb and finger. By compressing the removable cap 10, sufficient force is provided to the line of weakness 11 to locally break the outer wrapper 6. The user then removes the cap 10 by twisting the cap to break the remaining portion of the line of weakness 11. When the cap 10 is removed, a front portion of the combustible heat source 101 of the aerosol-generating component 100 is exposed, which enables the user to ignite the combustible heat source 101.

As shown in FIG. 1, a plurality of circumferential air inlets 12 is provided in the outer wrapper 6, overlying the aerosol-generating component 100. The air inlets 12 in the outer wrapper 6 are aligned with the air inlets 110 provided in the side wall 108 of the cup-shaped receptacle of the heat-transfer element 102. The aligned arrangement of air inlets 12, 110 admits cool air (not shown) into the cavity 109 containing the aerosol-forming substrate 103.

In use, a user ignites the combustible heat source 101 which heats the aerosol-forming substrate 103 to produce an aerosol. When the user draws on the mouthpiece 5 of the aerosol-generating article 1, air is drawn into the cavity 109 of the heat-transfer element 102 through the air inlets 12, 110.

The coating of aerosol-forming substrate 103 on the inner surface of the cup-shaped receptacle is heated by the combustible heat source 101 by conduction through the heat-transfer element 102, from the rear-end face 105 of the combustible heat source 101. The heating of the aerosol-forming substrate 103 by conduction releases glycerine and other volatile and semi-volatile compounds from the aerosol-forming substrate 103. The compounds released from the aerosol-forming substrate 103 form an aerosol that is entrained in the air drawn into the cavity 109 as it flows over the coating of aerosol-forming substrate 103.

The drawn air and entrained aerosol are drawn downstream through the interior of the cylindrical open ended hollow cellulose acetate tube 7 of the transfer element 2, the aerosol-cooling element 3 and the spacer element 4, where they cool and condense. The cooled drawn air and entrained aerosol are drawn further downstream through the mouthpiece 5 and are delivered to the user, for inhalation, through the proximal end of the aerosol-generating article 1.

Additional air inlets (not shown) may optionally be provided downstream of the aerosol-generating component 100 to allow additional cool air to be drawn into the aerosol-generating article 1 in order to dilute the aerosol and reduce the temperature thereof.

The heat-transfer element 102 forms a non-combustible, substantially gas impermeable barrier on the rear-end face 105 of the combustible heat source 101. The heat-transfer element 102 substantially isolates the air drawn through the aerosol-generating article 1 from the combustible heat source 101, such that in use, the air drawn through the aerosol-generating article 1 does not come into direct contact with the combustible heat source 101.

Figure 2:
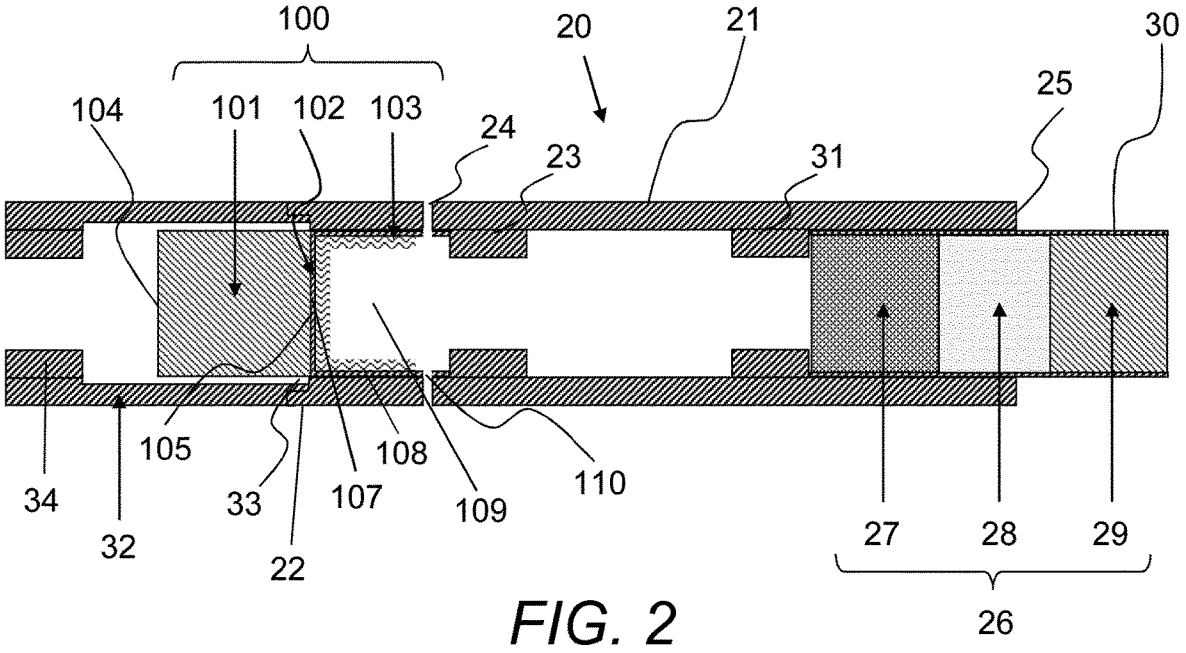
FIG. 2 shows a cross-sectional view of a second embodiment of an aerosol-generating article according to the present invention comprising the aerosol-generating component shown in FIG. 1.

An aerosol-generating article 20 according to a second embodiment of the invention is shown in FIG. 2. The aerosol-generating article 20 comprises an aerosol-generating component 100 and a holder. The aerosol-generating component 100 of the aerosol-generating article 20 shown in FIG. 2 is identical to the aerosol-generating component 100 of the aerosol-generating article 1 shown in FIG. 1 and previously described above. Like reference numerals in FIGS. 1 and 2 refer to like features.

The holder is durable and configured to be used multiple times. The holder comprises a housing 21 formed of polypropylene. The housing 21 is an elongate, hollow tubular element of substantially circular cross-section and has a length of about 80 mm, an inner radius of about 7 mm and an outer radius of about 10 mm, similar to a conventional cigarette or cigar.

The housing 21 has a distal end 22 comprising a substantially cylindrical first cavity that is configured to receive the heat-transfer element 102 of the aerosol-generating component 100. The inner radius of the first cavity is slightly smaller than the outer radius of the heat-transfer element 102, such that the first cavity receives the aerosol-generating component 100 with an interference fit.

As shown in FIG. 2, the holder comprises a first annular stop 23 that projects radially inwardly from the inner surface of the housing 21. The first annular stop 23 prevents the aerosol-generating component 100 from being inserted too far into the housing 21, and is arranged at a distance from the distal end 22 of the housing 21 that is slightly less than the length of the heat-transfer element 21. For example, the first annular stop 23 may be arranged at a distance from the distal end 22 of the housing 21 of about 8 mm. The location of the first annular stop 23 ensures that the length of the proximal portion of the heat-transfer element 102 received in the first cavity is sufficient to secure the aerosol-generating component 100 in the housing 21 by the interference fit. The location of the first annular stop 23 also ensures that a distal portion of the heat-transfer element 102 is not received in the first cavity. The distal portion of the heat-transfer element 102 that is not received in the first cavity may be gripped by a user in order to remove the aerosol-generating component 100 from the housing 21, once the combustible heat source 101 of the aerosol-generating component 100 has been expended.

It will be appreciated that in other embodiments (not shown) the aerosol-generating component 100 may be secured to the housing 21 by other suitable connection means known in the art, including but not limited to, a screw thread connection or a snap-fit connection. The distal end 22 of the housing 21 and the aerosol-generating component 100 may comprise complimentary connectors for securing the aerosol-generating component to the housing 21. For example, the aerosol-generating component 100 may comprise a male screw thread on the outer surface of the side wall 108 of the heat-transfer element 102 and the housing 21 may comprise a complementary female screw thread on the inner surface of the distal end of the first cavity.

It will be appreciated that in other embodiments (not shown) the first annular stop 23 may be replaced by one or more non-annular projections that project radially inwardly from the inner surface of the housing 21. It will also be appreciated that in further embodiments (not shown) the first annular stop 23 may be omitted and the inner surface of the housing 21 shaped, for example to include a shoulder or other reduced diameter portion, so as to prevent the aerosol-generating component 100 from being inserted too far into the housing 21.

As shown in FIG. 2, one or more circumferential air inlets 24 are provided in the housing 21. The air inlets 24 are arranged distally of the first annular stop 23. The location of the annular stop 23 is such that when the aerosol-generating component 100 is received in the first cavity of the housing 21, the plurality of circumferential air inlets 24 in the housing 21 are aligned with the air inlets 110 of the cup-shaped receptacle of the heat-transfer element 102. The aligned arrangement of air inlets 24, 110 admits cool air (not shown) into the cavity 109 of the cup-shaped receptacle of the heat-transfer element 102 containing the aerosol-forming substrate 103.

As shown in FIG. 2, a proximal end 25 of the housing 21 has a substantially circularly cylindrical second cavity. The second cavity is configured to receive a mouthpiece 26. The inner radius of the second cavity is slightly smaller than the outer radius of the mouthpiece 26, such that the second cavity receives the mouthpiece 26 with an interference fit. The mouthpiece 26 is a generally circularly cylindrical body with a radius of about 7 mm and a length of about 21 mm. The mouthpiece comprises an aerosol-cooling element 27, a spacer element 28 and a cylindrical plug of suitable filtration material 29 such as, for example, cellulose acetate tow of very low filtration efficiency, arranged in abutting coaxial alignment and wrapped in filter plug wrap 30.

A second annular stop 31 projects radially inwardly from the inner surface of the housing 21. The second annular stop 31 is arranged at a distance from the proximal end 25 of the housing 21 that is less than the length of the mouthpiece 26, such that the second annular stope 31 substantially prevents the mouthpiece 26 from being inserted too far into the housing 21. The second annular stop 31 may be arranged at a distance from the proximal end 25 of the housing 21 that is about two thirds or 70% of the length of the mouthpiece 26. For example, the second annular stop 31 may be arranged at a distance from the proximal end 25 of the housing 21 of about 20 mm.

The arrangement of the second annular stop 31 ensures that the length of the distal portion of the mouthpiece received in the second cavity is sufficient to secure the mouthpiece 26 in the housing by the interference fit. The arrangement of the second annular stop 31 also ensures that a proximal portion of the mouthpiece 26 is not received in the second cavity. In use, the proximal portion of the mouthpiece 26 not received in the second cavity is drawn on by a user, to draw air and aerosol generated by the aerosol-generating article 20 through the aerosol-generating article and to the user for inhalation.

It will be appreciated that in other embodiments (not shown) the mouthpiece 26 may not protrude from the proximal end 25 of the housing 21 and, in use, a user may draw on the proximal end 25 of the housing 21.

The aerosol-generating article 20 may optionally further comprise a removable protective cover 32 at the distal end thereof to shield the combustible heat source 101 of the aerosol-generating component 100. As shown in FIG. 2, the protective cover 32 is attached to the proximal end 25 of the housing 21. The protective cover 32 is an elongate tubular element of substantially circular cross-section and is formed of the same material as the housing 21. However, it will be appreciated that in other embodiments (not shown) the protective cover 32 may be formed of a material having a lower thermal conductivity than the housing 21.

The protective cover 21 has a length of about 20 mm, an inner radius of about 8 mm and an outer radius of about 10 mm. The protective cover 32 has a larger inner radius than the housing 21, to provide an air gap between the combustible heat source 101 of the aerosol-generating component 100 and the inner surface of the protective cover 32. In use, the air gap allows air to flow around the combustible heat source 101 to support sustained combustion. In use, the air gap also insulates the protective cover 32 from the combustible heat source 101.

The protective cover 32 has an inwardly extending lip 34 at its distal end to facilitate capture of solid by-products of combustion of the combustible heat source 101. The protective cover may have air inlets (not shown) to increase the airflow to the combustible heat source to further support sustained combustion. The protective cover 32 may also have a reflective coating on the inner surface to reduce heat loss from the combustible heat source 101.

The protective cover 32 is attached to the distal end 22 of the housing 21 by an interference fit. As shown in FIG. 2, an annular tongue 33 is provided at the proximal end of the protective cover 32 that fits inside an annular groove provided at the distal end 22 of the housing 21.

It will be appreciated that in other embodiments (not shown) the protective cover 32 may be secured to the housing 21 by other suitable connection means known in the art, including but not limited to, a screw thread connection or a snap-fit connection.

In use, to assemble the aerosol-generating article 20, the aerosol-generating component 100 is inserted into the first cavity at the distal end 22 of the housing 21, with the heat-transfer element 102 being received in the first cavity. The mouthpiece 26 is also inserted into the second cavity at the proximal end 25 of the housing 21. A user ignites the combustible heat source 101 and then secures the protective cover 32 onto the distal end 22 of the housing 21, to shield the combustible heat source 101 during combustion. The coating of aerosol-forming substrate 103 on the inner surface of the cup-shaped receptacle of the heat-transfer element 102 is heated by the combustible heat source 101 by conduction from the rear-end face 105 through the heat-transfer element 102.

When the user draws on the mouthpiece 26 of the aerosol-generating article 20, ambient air is drawn into the cavity 109 of the heat-transfer element 102 through the air inlets 24, 110. As previously described in relation to the aerosol-generating article 1 of FIG. 1, heating of the aerosol-forming substrate 103 by conduction releases glycerine and other volatile and semi-volatile compounds from the aerosol-forming substrate 103 that are entrained in the air drawn into the cavity 109 as it flows over the coating of aerosol-forming substrate 103. The drawn air and entrained aerosol are drawn downstream through the interior of the housing 21, the aerosol-cooling element 27 of the mouthpiece 26 and the spacer element 28 of the mouthpiece 26, where they cool and condense. The cooled drawn air and entrained aerosol are delivered to the user through the plug of filtration material 29 at the proximal end of the mouthpiece 26.

Additional air inlets (not shown) may optionally be provided towards the proximal end 25 of the housing 21 to allow additional cool air to be drawn into the aerosol-generating article 20 in order to dilute the aerosol and reduce the temperature thereof.

Once combustion of the combustible heat source has ceased, the user may remove the protective cover 32 from the aerosol-generating article 20 by pulling the protective cover 32 away from the housing 21. The user may then remove the aerosol-generating component 100 from the aerosol-generating article 20 by pulling the aerosol-generating component 100 away from the housing 21. The aerosol-generating component 100 may then be discarded by the user. The housing 21 may be retained by the user for subsequent use with another aerosol-generating component 100.

The mouthpiece 26 may optionally be removed from the aerosol-generating article 20 by pulling the mouthpiece 26 away from the housing 21 and discarded by the user.

It will be appreciated that in other embodiments (not shown) a tool such as, for example, a pair of tweezers may be provided to assist the user in removing the aerosol-generating component 100 from the aerosol-generating article 20.

FIGS. 3 to 8 show other embodiments of aerosol generating-components according to the present invention for use in aerosol-generating articles according to the present invention.

Figure 3:
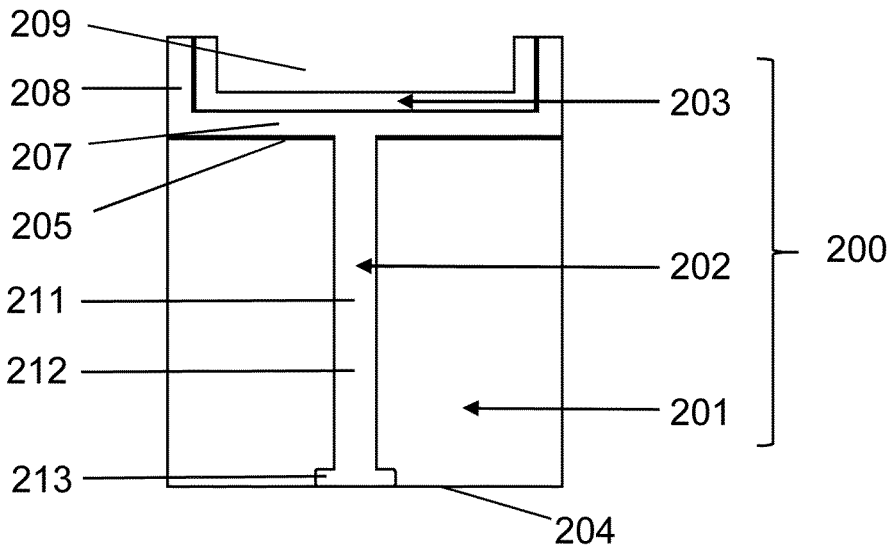
FIG. 3 shows a cross-sectional view of a second embodiment of an aerosol-generating component according to the present invention.

The aerosol-generating component 200 shown in FIG. 3 is substantially similar to the aerosol-generating component 100 shown in FIGS. 1 and 2. The aerosol-generating component 200 comprises a combustible heat source 301, a heat-transfer element 202 and an aerosol-forming substrate 203.

The combustible heat source 201 is a blind heat source, and comprises a substantially circularly cylindrical solid body of combustible carbonaceous material, similar to the combustible heat source 101 of the component 100. The combustible heat source 202 also has a front face 204 and a rear face 205.

The heat-transfer element 202 comprises an aluminium cup-shaped receptacle, comprising a base 207 and a sidewall 208. The sidewall 208 extends from the base 207 and circumscribes the base 207 to form a cavity 209 from the base 207 and the sidewall 208. No air inlets are provided in the side wall 208; however, it will be appreciated that in other embodiments (not shown) one or more air inlets may be provided in the side wall 208.

The aerosol-forming substrate 203 forms a coating on an inner surface of the cup-shaped receptacle, in the cavity 209. The coating extends over base 207 and substantially over the entire sidewall 208. It will be appreciated that in other embodiments (not shown), the coating of aerosol-forming substrate 203 extends only partially over the sidewall 208, to provide one or more uncoated portions of the inner surface, where air inlets may be provided.

The heat-transfer element 202 is arranged in direct contact with the combustible heat source 201. The outer surface of the base 207 directly contacts the rear face 205 of the combustible heat source 201.

The heat-transfer element 302 further comprises a protrusion 211 that is integrally formed with the cup-shaped receptacle. The protrusion comprises an elongate portion 212 extending towards the combustible heat source 201 from the centre of the base 207. The protrusion 211 extends into and through the combustible heat source 201, from the rear face 205 to the front face 204, such that the combustible heat source forms an annular body about the elongate portion 212. The protrusion 211 increases the surface area of the heat-transfer element 202 that is in contact with the combustible heat source 201, which facilitates conductive heat transfer from the combustible heat source 201 to the aerosol-forming substrate 203. The protrusion 211 also further secures the combustible heat source 201 to the heat-transfer element 202.

The elongate portion 212 has a length of about 10 mm and an outer radius of about 2 mm. The elongate portion 212 has a substantially circular cross-section. The distal end of the elongate portion 212, furthest from the base 207, is flared radially outwardly to form a flange 213. The flange 213 having an outer radius of about 4 mm. The flange 213 further improves mechanical retention of the combustible heat source 201 on the heat-transfer element 202.

It will be appreciated that the elongate portion 212 and the flange 213 may have other suitable shapes and sizes, which may further improve mechanical retention of the combustible heat source on the heat-transfer element. It will also be appreciated that the flange 213 may be arranged at any point along the length of the elongate portion 212 and that more than one flange may be provided. In other embodiments (not shown), the elongate portion 212 does not comprise a flange.

Figure 4:
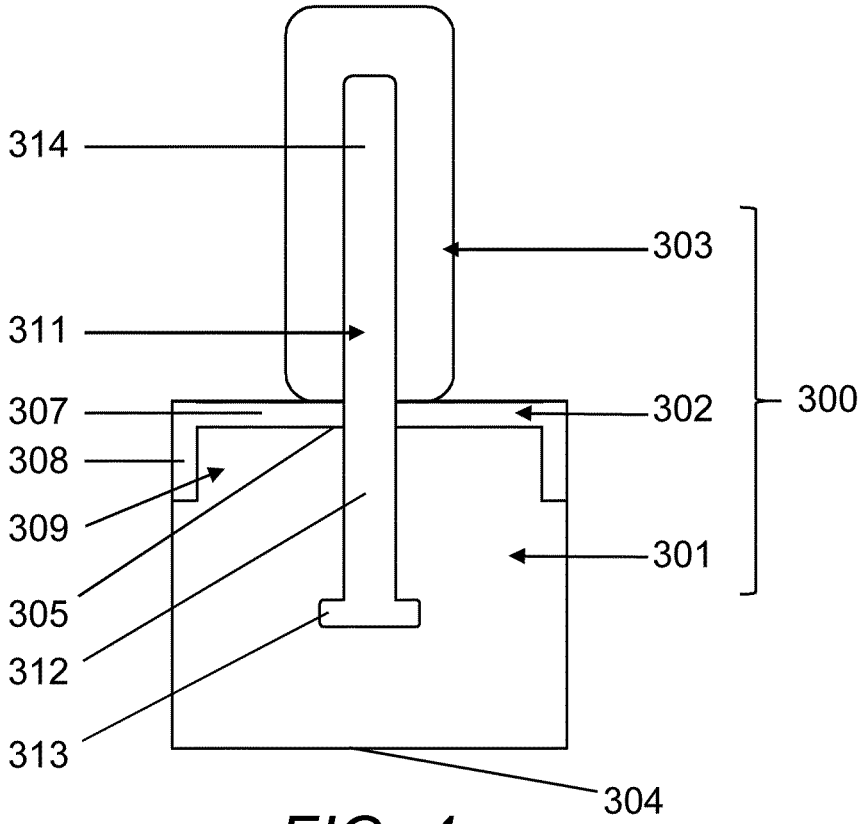
FIG. 4 shows a cross-sectional view of a third embodiment of an aerosol-generating component according to the present invention.

The aerosol-generating component 300 shown in FIG. 4 is substantially similar to the aerosol-generating component 200 shown in FIG. 3. The aerosol-generating component 300 comprises a combustible heat source 301, a heat-transfer element 302 and an aerosol-forming substrate 303.

The combustible heat source 301 is a blind heat source, and comprises a substantially circularly cylindrical solid body of combustible carbonaceous material, similar to the combustible heat source 201 of the component 200. The combustible heat source 302 also has a front face 304 and a rear face 305.

The heat-transfer element 302 comprises a ceramic cup-shaped receptacle, comprising a substantially circular base 307 and a substantially cylindrical sidewall 308. The sidewall 308 extends from the base 307 and circumscribes the base 307 to form a cylindrical cavity 309 from the base 307 and sidewall 308. No air inlets are provided in the side wall 308; however, it will be appreciated that in other embodiments (not shown) one or more air inlets may be provided in the side wall 308.

The heat-transfer element 302 is arranged differently to the heat-transfer element 202 of the component 200. The heat-transfer element 302 is arranged with the inner surface of the cup-shaped receptacle, defining the cavity 309, directly in contact with the rear face 305 of the combustible heat source 301. The sidewall 308 extends over a rear portion of the sides of the combustible heat source 301 and secures the combustible heat source 301 to the heat-transfer element 302.

The heat-transfer element 302 further comprises a protrusion 311. The protrusion 311 is not integrally formed with the cup-shaped receptacle of the heat-transfer element 302, but rather comprises a metallic pin having an elongate front portion 312 extending towards the combustible heat source 301. The elongate front portion 312 extends into the combustible heat source 301, but does not extend to the front face 304. The elongate front portion 312 extends into the combustible heat source 301 from the rear face 305 about half the length of the combustible heat source 301. The distal end of the elongate portion 312, furthest from the base 307, is flared radially outwardly to form a flange 313.

The protrusion 311 further comprises an elongate rear portion 314 extending away from the combustible heat source 301. The elongate rear portion 314 extends through a hole in the base 307 of the cup-shaped receptacle.

The aerosol-forming substrate 303 forms a coating on the surface of the rear portion 314 of the protrusion 311 that extends from the base 307 of the heat-transfer element 302.

It will be appreciated that the heat-transfer element 302 may be provided with more than one protrusion 311.

In other embodiments (not shown), the heat-transfer element 302 does not comprise a cup-shaped receptacle comprising a base 307 and a sidewall 308, but rather comprises the base 307, without the sidewall 308. The base 307 separates the combustible heat source 301 from the aerosol-forming substrate 303.

In other embodiments (not shown), the combustible heat source 301 is not a blind heat source, but rather has one or more longitudinal passages extending from the front face 304 to the rear-face 305. In some embodiments, the base 307 of the heat-transfer element may cover the open ends of the one or more passages. In other embodiments, the base 307 comprises one or more air inlets, complimentary to the longitudinal passages of the combustible heat source 301, to enable heated air to pass through the longitudinal passages and over the aerosol-forming substrate 303.

Figure 5:
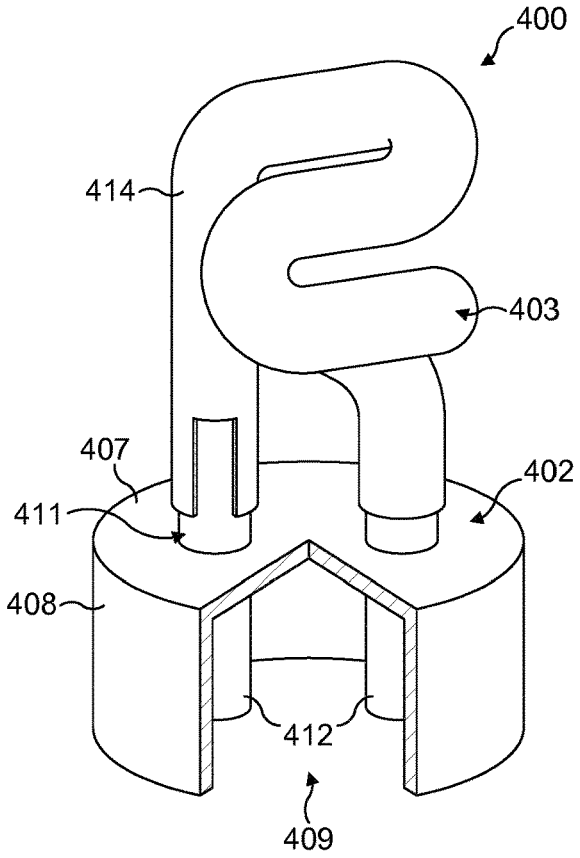
FIG. 5 shows a cut-away isometric view of a fourth embodiment of an aerosol-generating component according to the present invention.

The aerosol-generating component 400 shown in FIG. 5 is substantially similar to the aerosol-generating component 300 shown in FIG. 4. The aerosol-generating component 400 comprises a combustible heat source (not shown), a heat-transfer element 402 and an aerosol-forming substrate 403.

The heat-transfer element 402 comprises a ceramic cup-shaped receptacle comprising a substantially circular base 407 and a substantially cylindrical sidewall 408, forming a cavity 409 for receiving the combustible heat source (not shown).

The heat-transfer element 402 further comprises a metallic protrusion 411. The protrusion 411 comprises a first and second ends 412 that extend into the cavity 409, towards the combustible heat source (not shown). A central portion of the protrusion 411, between the first and second ends 412, extends away from the combustible heat source, through the base 407 of the cup-shaped receptacle, at two holes (not shown).

The central portion 414 of the protrusion 411 is bent, folded, or twisted in a plurality of directions. Arranging the central portion in a bent, folded or twisted arrangement enables the central portion to be compacted close to the cup-shaped receptacle. The central portion 414 provides a greater surface area for aerosol-forming substrate 403 to coat.

It will be appreciated that the heat-transfer element 402 may be provided with more than one protrusion 411. It will also be appreciated that the one or more protrusions 411 may be bent, folded or twisted in any suitable arrangement.

Figure 6:
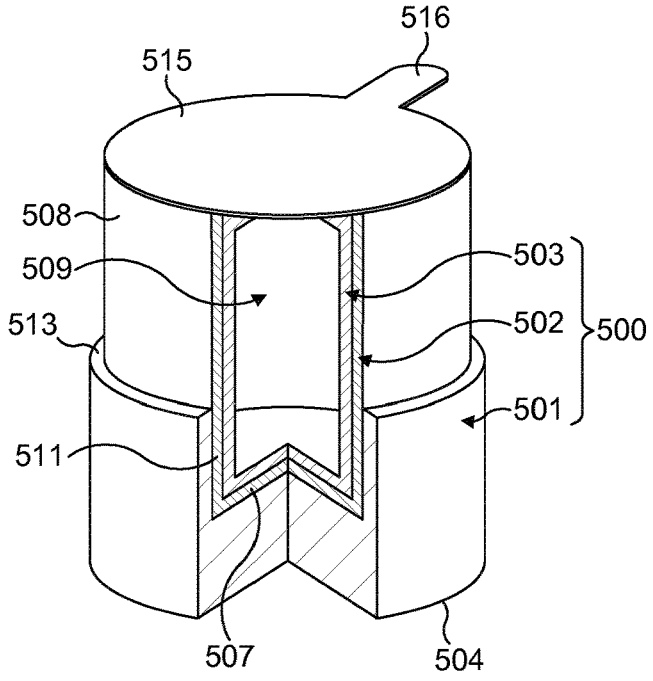
FIG. 6 shows a cut-away isometric view of a fifth embodiment of an aerosol-generating component according to the present invention.

The aerosol-generating component 500 shown in FIG. 6 is substantially similar to the aerosol-generating component 200 shown in FIG. 3. The aerosol-generating component 500 comprises a combustible heat source 501, a heat-transfer element 502 and an aerosol-forming substrate 503.

The combustible heat source 501 is a blind heat source, and comprises a substantially circularly cylindrical solid body of combustible carbonaceous material. The combustible heat source 502 also has a front face 504 and a rear face 505.

The heat-transfer element 502 comprises an aluminium cup-shaped receptacle, comprising a substantially circular base 507 and a substantially cylindrical sidewall 508. The sidewall 508 extends from the base 507 and circumscribes the base 507 to form a cavity 509 from the base 507 and the sidewall 508. The sidewall 508 is longer than the sidewalls of the other embodiments, having a length of about 14 mm, and the base 507 is smaller than the bases of the heat-transfer elements of the other embodiments, having a radius of about 4 mm. The sidewall 508 extends from the base 507 to a shoulder 513, at about 4 mm from the base 507. At the shoulder 513, the sidewall flares radially outwardly such that between the shoulder 513 and the open end of the cup-shaped receptacle, the radius of the cup-shaped receptacle is about the same as that of the other embodiments. The radius of the cup-shaped receptacle between the shoulder 513 and the open end is about 7 mm.

The aerosol-forming substrate 503 forms a coating on an inner surface of the cup-shaped receptacle, in the cavity 509. The coating extends over the base 507 and substantially over the entire sidewall 508.

The heat-transfer element 502 is arranged in direct contact with the combustible heat source 501. The outer surface of the base 507 directly contacts the rear face 505 of the combustible heat source 201. The combustible heat source 501 also extends over the sidewall 508, up to the shoulder 513. This arrangement improves the conductive heat transfer between the combustible heat source 501 and the heat-transfer element 502.

In this arrangement, the portion 511 of the heat-transfer element between the shoulder 513 and the base 507 is similar to the protrusion 211 of the component 200 shown in FIG. 3. However, the protrusion 511 is a hollow protrusion and the cavity 509 extends into the hollow protrusion 511.

It will be appreciated that any suitable methods may be used to manufacture the aerosol-generating component 500.

One suitable method of manufacturing the aerosol-generating component 500 comprises a first step of positioning a portion of combustible material with respect to a web of heat conductive material, a second step of pressing the heat-conductive material and the combustible material together to form the combustible heat source 501 and the heat-transfer element 503, and a third step of applying a coating of an aerosol-forming material to the inner surface of the cup-shaped receptacle, in the cavity 509, to form the aerosol-forming substrate 503.

Another suitable method of manufacturing the aerosol-generating component 500 comprises a first step of pressing a portion of combustible material to form the combustible heat source 501, the combustible heat source 501 having a cavity, a second step of pressing a web of heat-conductive material onto the combustible heat source such that heat-conductive material lines the cavity of the combustible heat source 501 to form the heat-transfer element 503 and the cavity 509, and a third step of applying a coating of an aerosol-forming material to the inner surface of the cup-shaped receptacle, in the cavity 509, to form the aerosol-forming substrate 503.

Another suitable method of manufacturing the aerosol-generating component 500 comprises a step of forming a web of heat-conductive material into a predetermined shape to form the heat-transfer element 502 and the cavity 509, a step of applying a coating of an aerosol-forming material to at least a portion of the inner surface of the cup-shaped receptacle, in the cavity 509 to form the aerosol-forming substrate 503, and a step of applying a portion of combustible material to at least a portion of an outer surface of the cavity 509 to form the combustible heat source 501.

It will be appreciated that the steps of applying a coating of an aerosol-forming material and applying a portion of combustible material may be performed in any order.

It will be appreciated that the methods described above in relation to the manufacture of the aerosol-generating component 500 shown in FIG. 4 may also be used to manufacture other aerosol-generating components described herein.

As shown in FIG. 6, the cavity 509 of the cup-shaped receptacle of the heat-transfer element 502 may be optionally closed with a removable lid 515. The lid 515 is comprised of a laminated composite film comprising a layer of polymer and a layer of aluminium. The lid is heat-welded to the side wall 508 of the cup-shaped receptacle to seal the cavity 509. The lid comprises a tab 516 to facilitate removal of the lid 515 from the cup-shaped receptacle. In use, before inserting the aerosol-generating component 500 into a holder of an aerosol-generating article, a user may grip the tap 516 and peel the lid 515 from the cup-shaped receptacle.

In other embodiments (not shown) the lid 515 may be piercable. In such embodiments, the holder of the aerosol-generating article into which the aerosol-generating component 500 is received may comprise a piercing element for piercing the lid 515.

Figure 7:
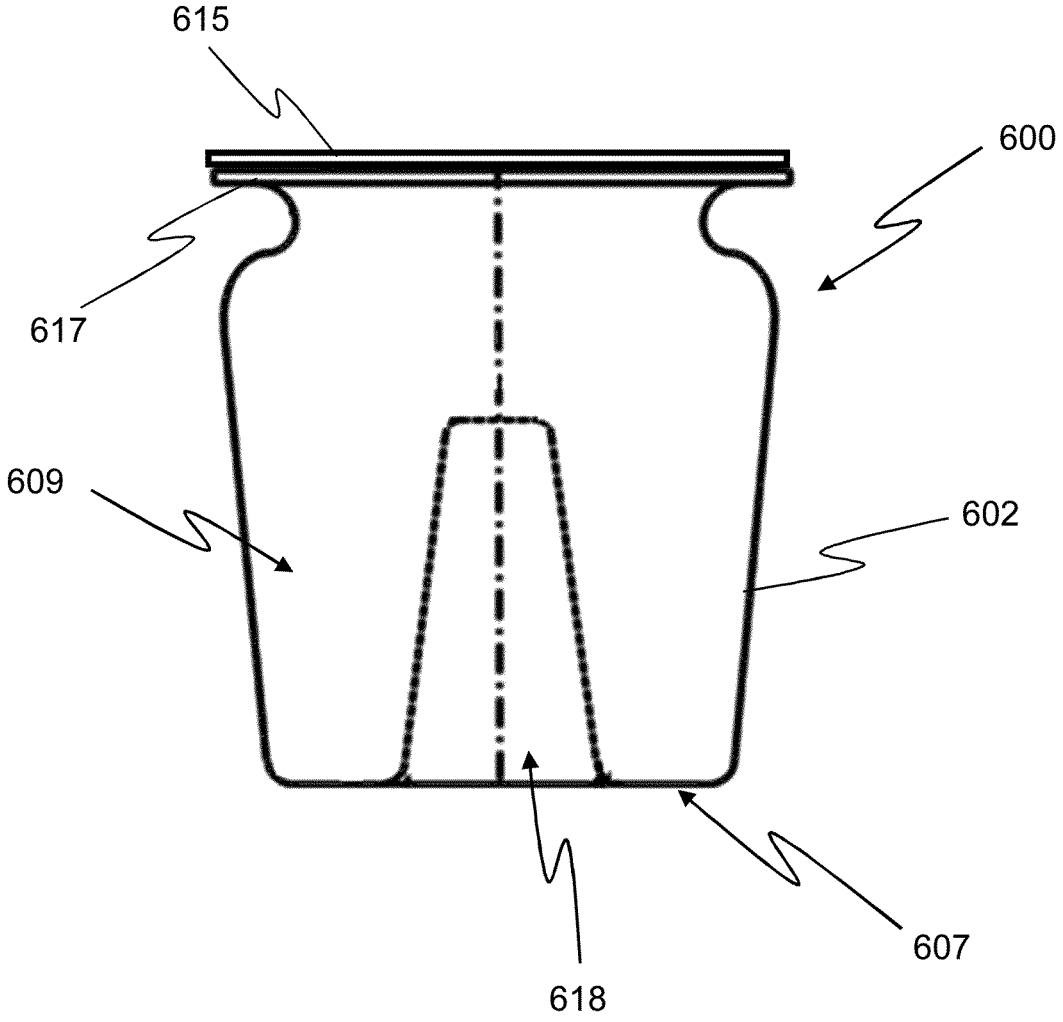
FIG. 7 shows a cross-sectional view of a sixth embodiment of an aerosol-generating component according to the present invention.

The aerosol-generating component 600 shown in FIG. 7 is substantially similar to the aerosol-generating component 500 shown in FIG. 6. The aerosol-generating component 600 comprises a combustible heat source (not shown), a heat-transfer element 602 and an aerosol-forming substrate (not shown).

The heat-transfer element 602 comprises a metallic cup-shaped receptacle, comprising a base 607 and a sidewall.

The sidewall extends from the base 607 and circumscribes the base 607 to form a cavity 609 from the base 607 and sidewall.

As shown in FIG. 7, the aerosol-generating component 600 optionally comprises a lid 615. The lid 615 is welded or otherwise affixed to a lip 617 at the open end of the cup-shaped receptacle to seal the cavity 609. Before the lid 615 is welded or otherwise affixed to the lip 617, a coating of aerosol-forming substrate (not shown) is applied to the inner surface of the cup-shaped receptacle, in the cavity 609. The lid 615 may be of substantially similar construction to the lid 515 shown in FIG. 6 and described above.

The heat-transfer element 602 does not comprise a protrusion extending towards or away from the combustible heat source (not shown). The heat-transfer element 602 comprises a recess 618 extending into the cavity 609. The aerosol-forming substrate (not shown) forms a coating on the inner surface of the cup-shaped receptacle, in the cavity 609, and on the outer surface of the recess 618. The combustible heat source (not shown) extends into the recess 618 and contacts the inner surface of the recess 618. The recess 618 increases the surface area of the heat-transfer element 602, which facilitates conductive heat transfer from the combustible heat source to the aerosol-forming substrate. The protrusion 611 also further secures the combustible heat source 601 to the heat-transfer element 602.

The heat-transfer element 602 may be formed by deep drawing, preferably in at least two stages. The method may comprise deep drawing the cup-shaped receptacle using a suitable die and punch. This stage may be performed in two stages. The method may comprise a further stage of forming the lip 617 at the proximal end of the cup-shaped receptacle. Further detail of suitable methods of forming heat-transfer element 602 is described in WO-A1-2015/101479. It will be appreciated that other methods described herein may also be used to manufacture the heat-transfer element 602 of the aerosol-generating component 600.

Figure 8:
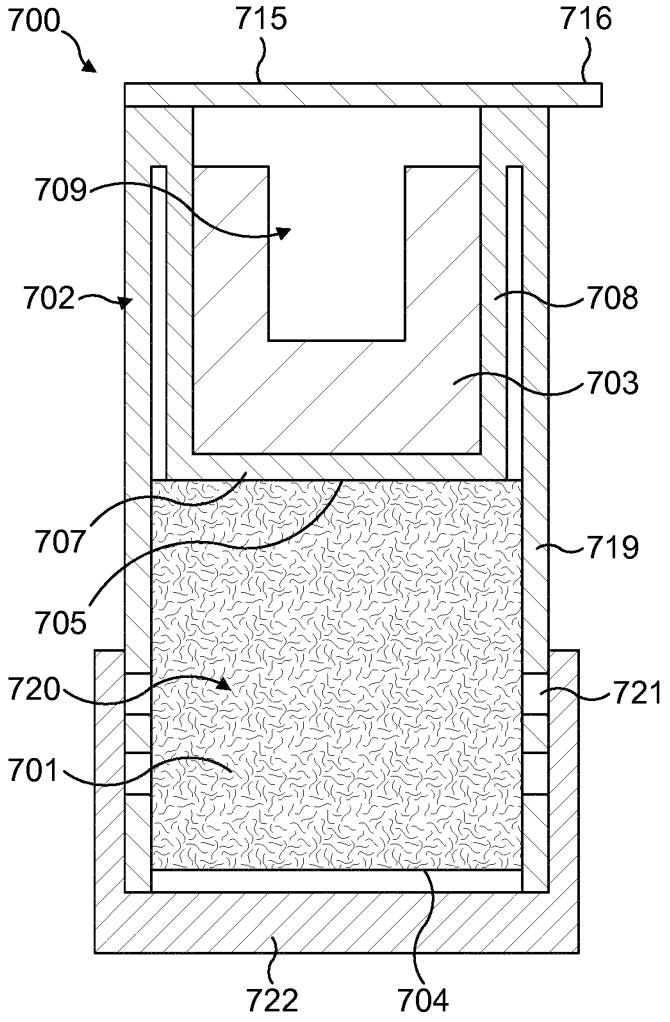
FIG. 8 shows a cross-sectional view of a fifth embodiment of an aerosol-generating component according to the present invention.

The aerosol-generating component 700 shown in FIG. 8 comprises a combustible heat source 701, a heat-transfer element 702 and an aerosol-forming substrate 703.

The heat-transfer element 702 is formed of a single sheet of aluminium foil having a thickness of about 0.3 mm. A central portion of the sheet of foil comprises a substantially circular base portion 707 and a sidewall 708 extending from and circumscribing the base portion 707. The base portion 707 and sidewall 708 form a first cup-shaped receptacle defining a first cavity 709. The aerosol-forming substrate is contained within the first cavity 709. The aerosol-forming substrate forms a coating on an inner surface of the first cup-shaped receptacle, in the first cavity 709. The coating of aerosol-forming substrate 703 is applied to the inner surfaces of the first cup-shaped receptacle, in the first cavity 709, substantially as previously described. The first cavity 709 is closed by a first lid 715 having a tab 716, which is substantially similar to the lid 515 of the component 500 shown in FIG. 6.

Outer portions 719 of the sheet of foil are folded over the first sidewall 708 and extend beyond the base portion 707, in the opposite direction to the first sidewall 708. The ends of the outer portions 719, extending beyond the base portion 707 form a second sidewall, circumscribing the base portion 707. The length of the second sidewall is about the same as the length of the first sidewall 707. The base portion 707 and the second sidewall form a second cup-shaped receptacle having a second cavity 720. The base portion 707 separates the first cavity 709 and the second cavity 720, such that the first cavity 709 directly opposes the second cavity 720. The combustible heat source 701 is contained within the second cavity 720. The rear face 701 of the combustible heat source 720 directly contacts the base portion 701, and the second sidewall extends beyond the front face 704 of the combustible heat source 701. Typically the combustible heat source 701 is pressed into the second cavity 720; however, the combustible heat source 701 may be applied to the inner surfaces of the second cup-shaped receptacle, in the second cavity 720, in a similar manner to the aerosol-forming substrate in the first cavity. Air inlets 721 are provided in the side walls of the second cup-shaped receptacle, for the cavity 720, to enable additional air to reach the combustible heat source 701 to support ignition and sustained combustion. The second cavity 720 is closed by a second lid 722. The second lid extends over the air inlets 721 to ensure that the second cavity 720 is completely enclosed. The second lid 721 is substantially similar to the lid 515 of component 500 shown in FIG. 6.

As shown in FIG. 8, the aerosol-generating component 700 comprises a heat-transfer element 702 forming two opposing cavities 709, 720. The aerosol-forming substrate 703 forms a coating on an inner surface of the first cavity 709 and the combustible heat source 701 directly contacts the inner surface of the second cavity 720. This arrangement improves conductive heat transfer between the combustible heat source 701 and the aerosol-forming substrate 703 and improves mechanical retention of the combustible heat source 701 on the heat-transfer element 702.

The heat-transfer element 702, comprising the two cavities 709, 720, is typically formed by a process of deep drawing. It will be appreciated by one of ordinary skill in the art that other methods may also be used to form the heat-transfer element 702 and the aerosol-generating component 700.

In other embodiments (not shown), the first cavity 709 may also comprise one or more air inlets in the sidewall 708, and the lid 715 may extend over the air inlets to close the first cavity 709.

In other embodiments (not shown), the second cup-shaped receptacle comprising the second cavity 720 may be formed from a second piece of material. For example, the second piece of material may be a tube of aluminium foil having similar dimensions to the first cup-shaped receptacle. The second piece of material may be secured to the outer surface of the base by any suitable means, such as by a mechanical connection such as an interference fit, a screw connection or a male or female connector or by bonding such as gluing.

It will be appreciated that features described for one embodiment may be provided in other embodiments.

The invention claimed is:

1. An aerosol-generating component for an aerosol-generating article, the aerosol-generating component comprising:

a solid combustible heat source;

an aerosol-forming substrate; and a heat-transfer element disposed between the combustible heat source and the aerosol-forming substrate, wherein the heat-transfer element comprises a cup-shaped receptacle defining a cavity, the aerosol-forming substrate forms a coating on at least a portion of an inner surface of the cup-shaped receptacle, and the combustible heat source is secured to the heat-transfer element.

2. The aerosol-generating component according to claim 1, wherein the heat-transfer element further comprises opposing first and second surfaces, the opposing first surface being the inner surface of the cup-shaped receptacle on which the aerosol-forming substrate forms the coating, and wherein the combustible heat source contacts at least a portion of the opposing second surface directly opposite the portion of the first surface on which the aerosol-forming substrate forms the coating.

3. The aerosol-generating component according to claim 1, wherein the cavity comprises an open end that is closed with a lid, the lid being removably secured to the heat-transfer element.

4. The aerosol-generating component according to claim 1, wherein:

the heat-transfer element further comprises two opposing cup-shaped receptacles, a first cup-shaped receptacle defining a first cavity and a second cup-shaped receptacle defining a second cavity, the aerosol-forming substrate forms a coating on at least a portion of an inner surface of the first cup-shaped receptacle, and the combustible heat source contacts at least a portion of an inner surface of the second cup-shaped receptacle.

5. The aerosol-generating component according to claim 4, wherein at least one of the first cavity and the second cavity is closed with a lid.

6. The aerosol-generating component according to claim 1, wherein the heat-transfer element further comprises one or more protrusions extending at least one of towards and away from the combustible heat source.

7. The aerosol-generating component according to claim 6, wherein the aerosol-forming substrate forms a coating on at least a portion of a surface of one or more of the protrusions.

8. The aerosol-generating component according to claim 6, wherein the combustible heat source contacts at least a portion of a surface of the one or more protrusions.

9. The aerosol-generating component according to claim 1, wherein the heat-transfer element is formed of a single piece of heat-conductive material.

10. The aerosol-generating component according to claim 1, wherein the aerosol-forming substrate comprises tobacco.

11. An aerosol-generating article comprising an aerosol-generating component according to claim 1.

12. The aerosol-generating article according to claim 11, further comprising a holder configured to receive the aerosol-generating component.

13. A method of manufacturing an aerosol-generating component according to claim 1, the method comprising:

positioning a portion of combustible material relative to a portion of heat-conductive material;

pressing the portion of heat-conductive material and the portion of combustible material together to form the combustible heat source and the heat-transfer element, the heat transfer element comprising a cup-shaped receptacle defining a cavity; and applying a coating of an aerosol-forming material to a least a portion of an inner surface of the cup-shaped receptacle to form the aerosol-forming substrate.

* * * * *